US008855510B2

(12) United States Patent
Noh

(10) Patent No.: US 8,855,510 B2
(45) Date of Patent: Oct. 7, 2014

(54) IMAGE FORMING APPARATUS AND FIXING UNIT CONTROL METHOD THEREOF

(75) Inventor: Jin-woo Noh, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 496 days.

(21) Appl. No.: 13/241,855

(22) Filed: Sep. 23, 2011

(65) Prior Publication Data

US 2012/0141150 A1 Jun. 7, 2012

(30) Foreign Application Priority Data

Dec. 2, 2010 (KR) ..... 10-2010-0122128
Apr. 6, 2011 (KR) ..... 10-2011-0031664

(51) Int. Cl.
*G03G 15/20* (2006.01)
*G03G 15/00* (2006.01)

(52) U.S. Cl.
CPC ..... *G03G 15/2039* (2013.01); *G03G 15/55* (2013.01); *G03G 2215/2032* (2013.01)
USPC ..... 399/33

(58) Field of Classification Search
USPC ..... 399/33
See application file for complete search history.

(56) References Cited

U.S. PATENT DOCUMENTS 3,734,604 A * 5/1973 Szostak et al. ..... 399/33
4,801,974 A * 1/1989 Suto et al. ..... 399/33
4,994,852 A * 2/1991 Matsuuchi et al. ..... 399/33
5,754,917 A * 5/1998 Fromm et al. ..... 399/33
6,246,842 B1 * 6/2001 McClure ..... 399/33
6,597,879 B2 * 7/2003 Akutsu et al. ..... 399/69
7,058,330 B2 * 6/2006 Nakafuji et al. ..... 399/69
2003/0053811 A1 * 3/2003 Takayama ..... 399/33
2003/0206745 A1 * 11/2003 Akutsu et al. ..... 399/33
2008/0101805 A1 * 5/2008 Hyun ..... 399/33
2008/0159759 A1 * 7/2008 Park ..... 399/33
2008/0181632 A1 * 7/2008 Kim ..... 399/33

(Continued)

FOREIGN PATENT DOCUMENTS

EP 1939694 7/2008
JP 2003-140508 5/2003
JP 2004-077595 3/2004
JP 2010019926 1/2010

OTHER PUBLICATIONS

Machine translation of JP 2003140508 A.*
Machine translation of JP 2004077595 A.*

(Continued)

*Primary Examiner* — David Bolduc
(74) *Attorney, Agent, or Firm* — Stanzione & Kim, LLP

(57) ABSTRACT

Disclosed are an image forming apparatus and a fixing unit control method thereof, the image forming apparatus including an image forming unit, a fixing unit, a power supply to supply operating power to the fixing unit, a temperature sensor to sense a temperature of the fixing unit, a first protection unit to compare the sensed result of the temperature sensor with a first predetermined reference value and to output a signal, a switching unit to turn on/off power supplied to the fixing unit in accordance with the signal output from the first protection unit, a second protection unit to compare the sensed result of the temperature sensor with a second predetermined reference value and to output a signal, and a relay unit to turn on/off the operating power supplied to the fixing unit in accordance with the signal output from the second protection unit.

28 Claims, 8 Drawing Sheets

(56) References Cited

U.S. PATENT DOCUMENTS

| | | | | |
|---|---|---|---|---|
| 2008/0232831 | A1* | 9/2008 | Kwon | 399/33 |
| 2009/0252521 | A1* | 10/2009 | Takami | 399/69 |
| 2010/0054766 | A1* | 3/2010 | Kim et al. | 399/33 |

OTHER PUBLICATIONS

Extended European Search Report Issued on Mar. 22, 2012 in EP Patent Application No. 11183263.0.

* cited by examiner

IMAGE FORMING APPARATUS AND FIXING UNIT CONTROL METHOD THEREOF

CROSS-REFERENCE TO RELATED APPLICATIONS

This application claims the benefit of priority under 35 U.S.C. §119 from Korean Patent Applications No. 10-2010-0122128, filed on Dec. 2, 2010 and No. 10-2011-0031664, filed on Apr. 6, 2011 in the Korean Intellectual Property Office, the disclosures of which are incorporated herein by reference in their entireties.

BACKGROUND OF THE INVENTION

1. Field of the Invention

The present general inventive concept generally relates to an image forming apparatus and a fixing unit control method thereof, and more particularly, to an image forming apparatus and a fixing unit control method thereof in which a relay unit is provided for hardware control of a fixing unit, and power supplied to the fixing unit is controlled in accordance with on/off operations of the relay unit.

2. Description of the Related Art

An image forming apparatus forms an image to be printed on a printing medium. The image forming apparatus may be embodied in a printer, a copy machine, a facsimile, a multi-function peripheral having two or more functions, etc.

Specifically, the image forming apparatus forms an image by an image forming unit which includes an image carrying body, an optical scanning unit to scan a beam to the image carrying body to form an electrostatic latent image, a developing unit to develop a toner image corresponding to the latent image formed on the image carrying body, and a transfer unit to transfer a toner developed on the image carrying body and charged with electricity to the printing medium.

An image transferred to the printing medium is thermally pressed by the fixing unit and discharged to the outside. The fixing unit is heated with supplied power and fixes the image on the printing medium.

The image forming apparatus is provided with a temperature sensing unit (or a temperature sensor) that senses temperature of the fixing unit in order to prevent the fixing unit from overheating, and controls power supplied to the fixing unit on the basis of sensing results.

The temperature sensing unit includes a thermistor contacting a fixing roller of the fixing unit and senses the temperature. The temperature of the fixing unit is controlled depending on the resistance of the thermistor.

For example, the image forming apparatus receives a resistance level of the thermistor varied depending on the temperature, and outputs a signal for controlling the fixing unit in accordance with the temperature of the target, thereby controlling the fixing unit to maintain proper temperature.

However, the temperature of the fixing unit may be abnormally controlled by noise and static of power supplied from the exterior, reliability of peripheral parts, and the like problems. Thus, there is a need of an additional safety device to prepare for an abnormal state of the fixing unit.

SUMMARY OF THE INVENTION

The present general inventive concept provides an image forming apparatus and a fixing unit control method thereof, in which a protection unit is provided for hardware control of a fixing unit when the fixing unit is overheated abnormally, so that a product liability (PL) accident due to error in temperature control for the fixing unit can be prevented and the fixing unit can be protected.

The present general inventive concept also provides an image forming apparatus and a fixing unit control method thereof, in which a relay switch is forcibly turned off to shut power off to the fixing unit if the relay switch is repetitively turned on/off, so that the image forming apparatus can be prevented from permanent failure.

The present general inventive concept also provides an image forming apparatus and a fixing unit control method thereof, in which it is recorded whether a relay switch is repetitively turned on/off, that the power to the fixing unit is shut off, etc. while informing a user of them, so that after-sales service can be smoothly provided as necessary.

The present general inventive concept also provides an image forming apparatus and a fixing unit control method thereof, in which repetitive on/off times of the relay switch are counted for each predetermined period of time, and on/off due to temporary overshooting and on/off due to operation error are distinguished, so that parts can be prevented from being replaced recklessly.

Additional aspects and advantages of the present general inventive concept will be set forth in part in the description which follows and, in part, will be obvious from the description, or may be learned by practice of the general inventive concept.

The foregoing and/or other aspects may be realized by providing an image forming apparatus including an image forming unit to form an image and to transfer the image onto a printing medium, a fixing unit o fix the image transferred onto the printing medium, a power supply to supply operating power to the fixing unit, a temperature sensor to sense a temperature of the fixing unit, a first protection unit to compare the sensed result of the temperature sensor with a first predetermined reference value and to output a signal according to a comparison result between the sensed result of the temperature sensor and the first predetermined reference value, a switching unit to turn on/off to pass through/cut off the operating power supplied to the fixing unit in accordance with a level of the signal output from the first protection unit, a second protection unit to compare a sensed result of the temperature sensor with a second predetermined reference value and to output a signal according to a comparison result between the sensed result of the temperature sensor and the second predetermined value, and a relay unit to turn on/off to pass through/cut off the operating power supplied to the fixing unit in accordance with a level of the signal output from the second protection unit.

The first protection unit may include a first comparator to receive a voltage from the temperature sensor and a first predetermined reference voltage and to output a signal according to a comparison result between the received voltage and the first predetermined reference voltage, and the switching unit may include a photo coupler to turn on/off in accordance with the signal output from the first comparator.

The second protection unit may include a second comparator to receive a voltage of the temperature sensor and a second predetermined reference voltage and to output a signal according to a comparison result between the received voltage and the second predetermined reference voltage, and the relay unit may include a relay switch to turn on/off in accordance with the signal output from the second comparator.

The image forming apparatus may further include a controller to control a switching operation of the switching unit in accordance with the sensed result of the temperature sensor.

The image forming apparatus may further include a transmitting interface unit to transmit the level of the signal output from the second protection unit to the controller, and a receiving interface unit to receive a control signal from the controller to turn off the relay unit and to output the control signal to the relay unit, and the controller counts a number of times the relay unit is turned on/off in accordance with the level of the signal received from the transmitting interface unit, and outputs the control signal to turn off the relay unit to the receiving interface unit if the counted number of times the relay unit is turned on/off is equal to or more than a first reference number of times.

The image forming apparatus may further include a memory unit to store the number of times the relay unit is turned on/off, and the controller outputs the control signal to turn off the relay unit if the number of times the relay unit is turned on/off stored in the memory unit is equal to or more than the first reference number of times.

The number of times the relay unit is turned on/off stored in the memory unit may be initialized when the image forming apparatus is powered on.

The memory unit may include a non-volatile memory.

The memory unit may store the number of times of the control signal to turn off the relay unit is output, and the controller may check, when the image forming apparatus is powered on, the number of times the control signal to turn off the relay unit is output which is stored in the memory unit, and stop operating the image forming apparatus if the checked number of off times is equal to or more than a second reference number of times.

The controller may check the number of times the relay unit is turned on/off accumulated in the memory unit when the image forming apparatus is powered on, and output the control signal to turn off the relay unit if the checked number of accumulated off times is equal to or more than the first reference number of time.

The controller may output a control signal to turn off the relay unit if the number of times the relay unit is turned on/off is equal to or more than the first reference number of times during a predetermined period of time.

The image forming apparatus may further include a user interface unit to inform a user of an off status of the relay unit.

The foregoing and/or other features and utilities of the present general inventive concept may also be realized by providing a fixing unit control method of an image forming apparatus including an image forming unit to form an image and to transfer the image onto a printing medium, a fixing unit to fix the image transferred onto the printing medium, and a power supply to supply operating power to the fixing unit, the method including sensing a temperature of the fixing unit, comparing a sensed result of the temperature sensing with a predetermined reference value and outputting a comparison result, and turning on/off operating power supplied to the fixing unit in accordance with the comparison result.

The image forming apparatus may further include a first protection unit to compare the sensed result with a first predetermined reference value and to output a signal according to a comparison result between the sensed result and the first predetermined reference value and a second protection unit to compare the sensed result with a second predetermined reference value and to output a signal according to a comparison result between the sensed result and the second predetermined reference value, and the turning on/off of the operating power may include turning off the operating power supplied to the fixing unit according to the signal output from at least one of the first protection unit and the second protection unit.

The image forming apparatus may include a switching unit to turn on/off to pass through/cut off the operating power supplied to the fixing unit in accordance with a level of the signal output from the first protection unit, and a relay unit to turn on/off to pass through/cut off the operating power supplied to the fixing unit in accordance with a level of the signal output from the second protection unit, and the method may further include receiving the level of the signal output from the second protection unit to turn on/off the relay unit, counting a number of times the relay unit is turned on/off in accordance with the received level of the signal output from the second protection unit, and outputting a control signal to turn off the relay unit if the counted number times is equal to or more than a reference number of times.

The method may further include storing the number of times the relay unit is turned on/off in a memory unit, and the outputting the control signal includes outputting a control signal to turn off the relay unit if the number of times the relay unit is turned on/off stored in the memory unit is equal to or more than the reference number of times.

The number of times the relay unit is turned on/off stored in the memory unit may be initialized when the image forming apparatus is powered on.

The memory unit may include a non-volatile memory.

The method may further include printing information about the number of times the relay unit is turned on/off stored in the memory unit.

The method may further include checking the number of times the relay unit is turned on/off accumulated in the memory unit when the image forming apparatus is powered on, and outputting the control signal to turn off the relay unit to shut power off to the fixing unit if the checked number of accumulated off times is equal to or more than the reference number of times.

The counting may include counting the number of times the relay unit is turned on/off during a preset period of time, and the outputting the control signal may include outputting the control signal to turn off the relay unit if the counted number of times the relay unit is turned on/off times is equal to or more than the reference number of times during the preset period of time.

The method may further include informing a user of an off status of the relay unit.

The foregoing and/or other features and utilities of the present general inventive concept may also be realized by providing an image forming apparatus including an image forming unit to form an image and to transfer the image onto a printing medium, a fixing unit to fix the image transferred onto the printing medium, a power supply to supply operating power to the fixing unit, a temperature sensor to sense a temperature of the fixing unit, a protection unit to compare a sensed result of the temperature sensor with a predetermined reference value and to output a signal in accordance with a comparison result between the sensed result of the temperature sensor and the predetermined reference value, a relay unit to turn on/off to pass through/cutoff the operating power supplied to the fixing unit in accordance with a level of the signal output from the protection unit, a transmitting interface unit to receive the level of the signal output from the protection unit and to output a signal in accordance with the level of the signal received from the protection unit, a receiving interface unit to output a control signal to the relay unit, and a controller to count the number of times the relay unit is turned on/off in accordance with a level of the signal received from the transmitting interface unit, and to output a control signal to turn off the relay unit to the receiving interface unit if the counted number of times the relay unit is turned on/off is equal to or more than a first reference number of times.

The image forming apparatus may further include a memory unit to store the number of times the relay unit is turned on/off, and the controller outputs the control signal to turn off the relay unit if the number of times the relay unit is turned on/off stored in the memory unit is equal to or more than the reference number of times.

The memory unit may store the number of times of the control signal to turn off the relay unit is output, and the controller may check the number of times the control signal to turn off the relay unit stored in the memory unit when the image forming apparatus is powered on, and stop operating the image forming apparatus if the checked number of off times is equal to or more than a second reference number of times.

The controller may check the number of times the relay unit is turned on/off accumulated in the memory unit when the image forming apparatus is powered on, and outputs the control signal to turn off the relay unit to shut power off to the fixing unit if the checked number of accumulated off times is equal to or more than the first reference number of times.

The controller may output a control signal to turn off the relay unit if the number of times the relay unit is turned on/off is equal to or more than the first reference number of times during a predetermined period of time.

The foregoing and/or other features and utilities of the present general inventive concept may also be realized by providing a fixing unit control method of an image forming apparatus including an image forming unit to form an image and to transfer the image onto a printing medium, a fixing unit to fix the image transferred onto the printing medium, and a power supply to supply operating power to the fixing unit, the method including sensing a temperature of the fixing unit, comparing the sensed result of the temperature sensing with a predetermined reference value, outputting a signal to turn on/off a relay unit to pass through/cut off the operating power supplied to the fixing unit in accordance with a comparison result between the sensed result and the predetermined reference value, monitoring a level of the signal to turn on/off the relay unit, counting the number of times the relay unit is turned on/off on the basis of the monitoring result, and outputting a control signal to turn off the relay unit if the counted number of times the relay unit is turned on/off is equal to or more than a reference number of times.

The counting may include counting the number of times the relay unit is turned on/off during a preset period of time, and the outputting the control signal may include outputting the control signal to turn off the relay unit if the counted number of times is equal to or more than the reference number of times during the preset period of time.

The foregoing and/or other features and utilities of the present general inventive concept may also be realized by providing a fixing unit control method of an image forming apparatus including an image forming unit to form an image and to transfer the image onto a printing medium, a fixing unit to fix the image transferred onto the printing medium, and a power supply to supply operating power to the fixing unit, the method including sensing a temperature of the fixing unit, comparing a sensed result of the temperature sensing with a predetermined reference value, outputting a signal to turn on/off a relay unit to pass through/cut off the operating power supplied to the fixing unit in accordance with a comparison result between the sensed result and the predetermined reference value, monitoring a level of the signal to turn on/off the relay unit, counting a number of times the relay unit is turned on/off on the basis of the monitoring result, storing the number of times the relay unit is turned on/off in a memory unit, checking the number of times the relay unit is turned on/off accumulated in the memory unit when the image forming apparatus is powered on, and outputting a control signal to turn off the relay unit to shut power off to the fixing unit if the checked number of accumulated off times of the relay unit is equal to or more than a reference number of times.

The foregoing and/or other features and utilities of the present general inventive concept may also be realized by providing a fixing unit control method of an image forming apparatus including an image forming unit to form an image and to transfer the image onto a printing medium, a fixing unit to fix the image transferred onto the printing medium, and a power supply to supply operating power to the fixing unit, the method including sensing a temperature of the fixing unit, comparing a sensed result of the temperature sensing with a predetermined reference value, outputting a signal to turn on/off a relay unit to pass through/cut off the operating power supplied to the fixing unit in accordance with a comparison result between the sensed result and a predetermined reference value, monitoring a level of the signal to turn on/off the relay unit, counting a number of times the relay unit is turned on/off on the basis of the monitoring result, outputting a control signal to turn off the relay unit to shut power off to the fixing unit if the number of times the relay unit is turned on/off is equal to or more than a first reference number of times, storing the number of times of outputting the control signal to turn off the relay unit in a memory unit, checking the number of times of outputting the control signal to turn off the relay unit stored in the memory unit when the image forming apparatus is powered on, and outputting a control signal to stop operation of the image forming apparatus if the checked number of times of outputting the control signal to turn off the relay unit is equal to or more than a second reference number of times.

The foregoing and/or other features and utilities of the present general inventive concept may also be realized by providing an image forming apparatus including a fixing unit to fix an image onto a printing medium, a power supply to supply operating power to the fixing unit, a temperature sensor to sense a temperature of the fixing unit, a protection unit to compare the sensed temperature with a predetermined reference value and to output a signal in accordance with a comparison result between the sensed temperature and the predetermined reference value, a switching unit disposed between the power supply and the fixing unit and including a semiconductor switch to turn on/off to pass through/cut off the operating power supplied to the fixing unit in accordance with a level of the signal output from the protection unit, and a relay unit disposed between the power supply and the fixing unit and including a physical switch to turn on/off to pass through/cut off the operating power supplied to the fixing unit in accordance with the level of the signal output from the protection unit.

The image forming apparatus may include a controller to output a control signal to turn on/off the semiconductor switch in accordance with the sensed temperature and a target temperature.

The controller may count a number of times the physical switch is turned on/off and outputs a control signal to turn off the physical switch if the counted number of times is equal to or greater than a first predetermined reference number.

The controller may count the number times the physical switch is turned on/off from a time when the image forming apparatus is turned on.

The controller may count the number of times the physical switch is turned on/off during a predetermined period of time.

The controller may count the number of times the controller outputs the control signal to turn off the relay unit, and when the image forming apparatus is powered on, the controller disables the image forming apparatus if the counted number of times the controller outputs the control signal to turn off the relay unit is equal to or greater than a second predetermined reference number.

The image forming apparatus may include a memory unit to store the counted number of times the physical switch is turned on/off and to store the counted number of times the controller outputs the control signal to torn off the relay unit.

The image forming may include a user interface unit to inform a user when the physical switch is turned off.

BRIEF DESCRIPTION THE DRAWINGS

Exemplary embodiments of the present general inventive concept will be more clearly understood from the following detailed description taken in conjunction with the accompanying drawings, in which.

DETAILED OF THE EMBODIMENTS

Figure 1:
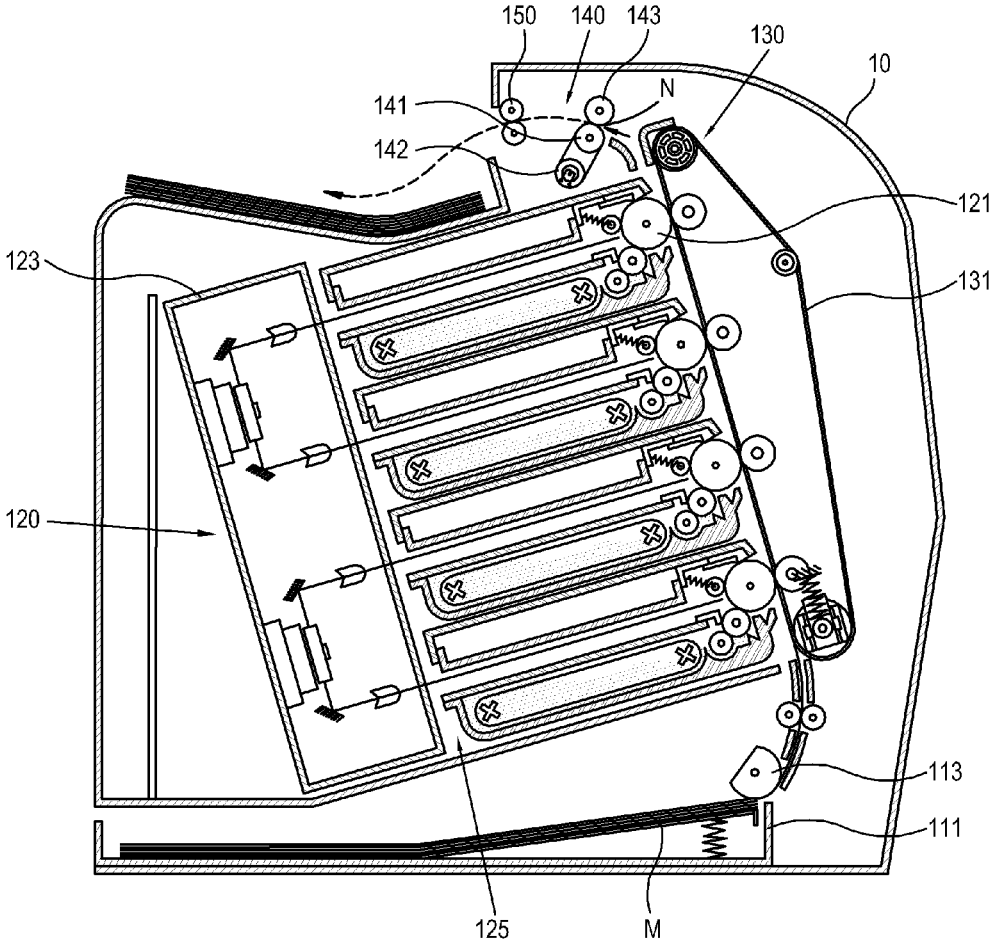
FIG. 1 is a schematic view of an image forming apparatus according to an exemplary embodiment.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a schematic view of an image forming apparatus according to an exemplary embodiment.

The image forming apparatus may be achieved by a printer, a copy machine, a facsimile, a multi-function peripheral having two or more functions, etc.

Referring to FIG. 1, the image forming apparatus in this exemplary embodiment is a tandem color image forming apparatus to form a color image by a single pass method, and includes a developing unit 125 having an image carrying body 121, an optical scanning unit 123, and a transfer unit 130. The developing unit 125, the optical scanning unit 123 and the transfer unit 130 are included in an image forming unit 120. The image forming unit 120 performs printing in accordance with a printing command. Here, the printing includes printing a copy after scanning a document, printing of received fax data, and printing of printing data received from an exterior through a host device (not shown) including a server or stored in an interior (e.g., a hard disk drive, HDD) or an exterior (e.g., a universal serial bus (USB) memory).

The image forming apparatus includes a fixing unit 140 to thermally press an image transferred on to a printing medium, and a discharging unit 150 to discharge the printing medium on which the image is fixed to the outside.

Inside the housing 10 forming an outer appearance of the image forming apparatus, a feeding unit 111 where the printing medium M to be supplied is stacked is detachably provided. The printing medium M stacked on the feeding unit 111 is picked up by a pickup roller 113, and transferred toward the transfer unit 130 through a transfer path.

The image carrying body 121 forms latent images corresponding to respective colors in accordance with a light beam scanned by the optical scanning unit 123. In this exemplary embodiment, first to fourth image carrying bodies are arranged in sequence from a feeding direction of the printing medium and are shown as a plurality of image carrying bodies 121.

The developing unit 125 accommodates a toner, and forms a toner image on the image carrying body 121.

There may be a plurality of developing units 125 corresponding to colors. FIG. 1 shows an example where the first to fourth developing units are configured to realize yellow (Y), magenta (M), cyan (C), and black (K), respectively.

According to this exemplary embodiment, the toner is accommodated in the developing unit 125, but not limited thereto. Alternatively, a developer feeding unit may be separately provided. In this case, the developer feeding unit may be divided into first to fourth developer feeding parts corresponding to developer colors, respectively. Further, the image carrying body 121 is placed inside the developing unit 125, but not limited thereto. Alternatively, the image carrying body 121 may be placed outside the developing unit 125.

The optical scanning unit 123 scans a beam to form latent images on the plurality of image carrying bodies 121, respectively. To this end, the optical scanning unit 123 includes a light source, a beam deflector for deflecting the beam emitted from the light source, an image formation lens for scanning and forming an image with a light beam deflected by the beam deflector on the image carrying body 121, and a reflecting member for changing an optical path of the beam scanned by the beam deflector.

The transfer unit 130 serves to transfer a visible image formed on the image carrying body 121 to the printing medium M supplied along a printing path. To this end, the transfer unit 130 may include a transfer belt 131 arranged to face the plurality of image carrying bodies 121.

The image transferred to the printing medium M through the transfer unit 130 is fixed by the fixing unit 140.

The fixing unit 140 forms a fixing nip N based on pressure, and fixes the transferred image by heating and pressing the print medium M passing through the fixing nip N. Specifically, the fixing unit 140 includes a heat roller 141 internally provided with a heater 142 to generate heat, and a press roller 143 closely contacting the heat roller 141 to form the fixing nip N. The heat roller 141 and the press roller 143 are rotated as being engaged by predetermined pressure, and applies heat and pressure to the image transferred on the printing medium M, thereby fixing the image on the printing medium M.

The heater 142 provided in the heat roller 141 may include a halogen lamp, a hot wire, an induction heater, etc.

The image forming apparatus may further include a temperature sensor 210 having a thermistor 211 contacting the fixing roller 141 to sense the temperature. The temperature of the fixing unit 140 is controlled by the resistance of the thermistor 211.

Figure 2:
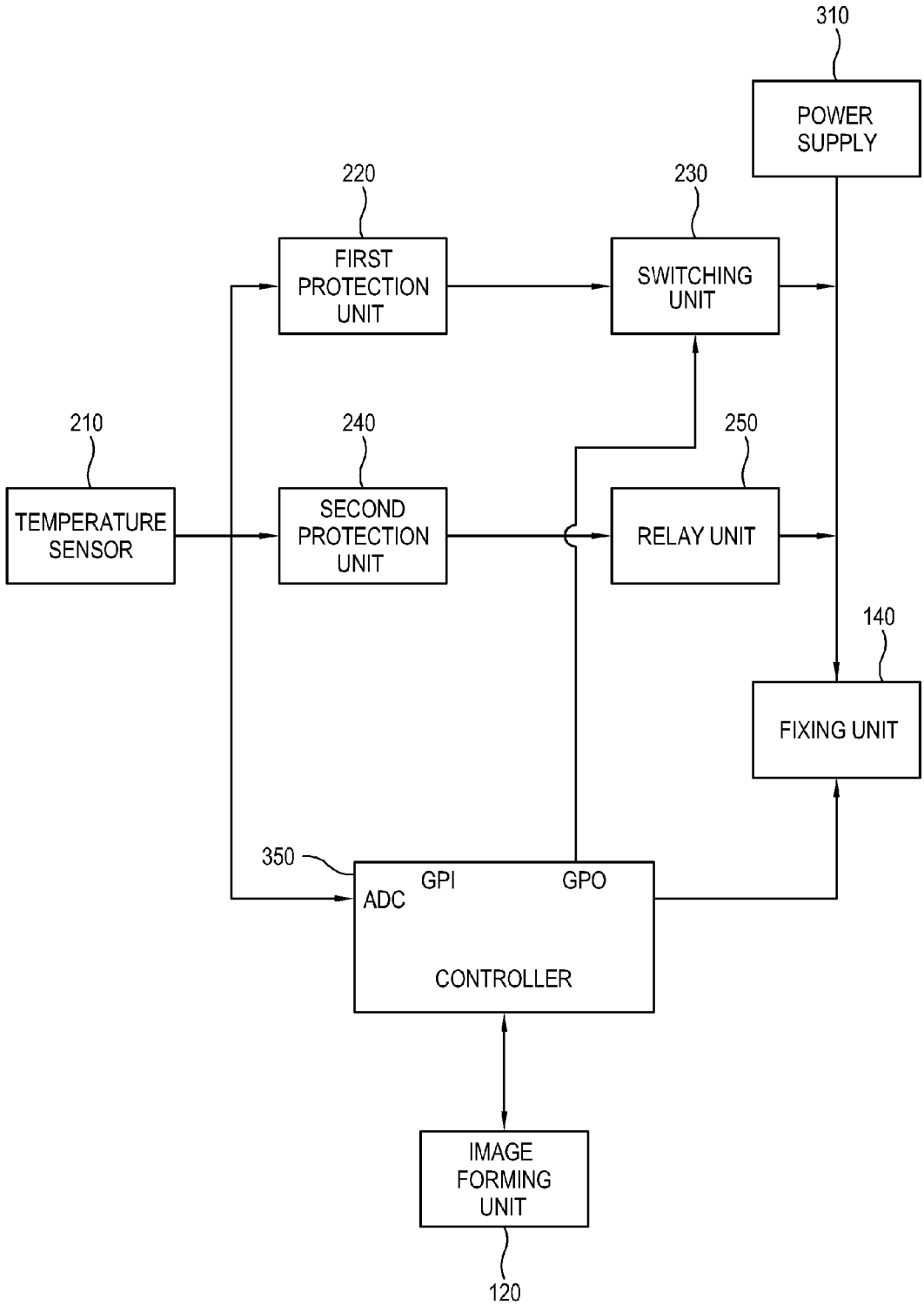
FIG. 2 is a block diagram showing a configuration of an image forming apparatus according to a first exemplary embodiment.
Figure 3:
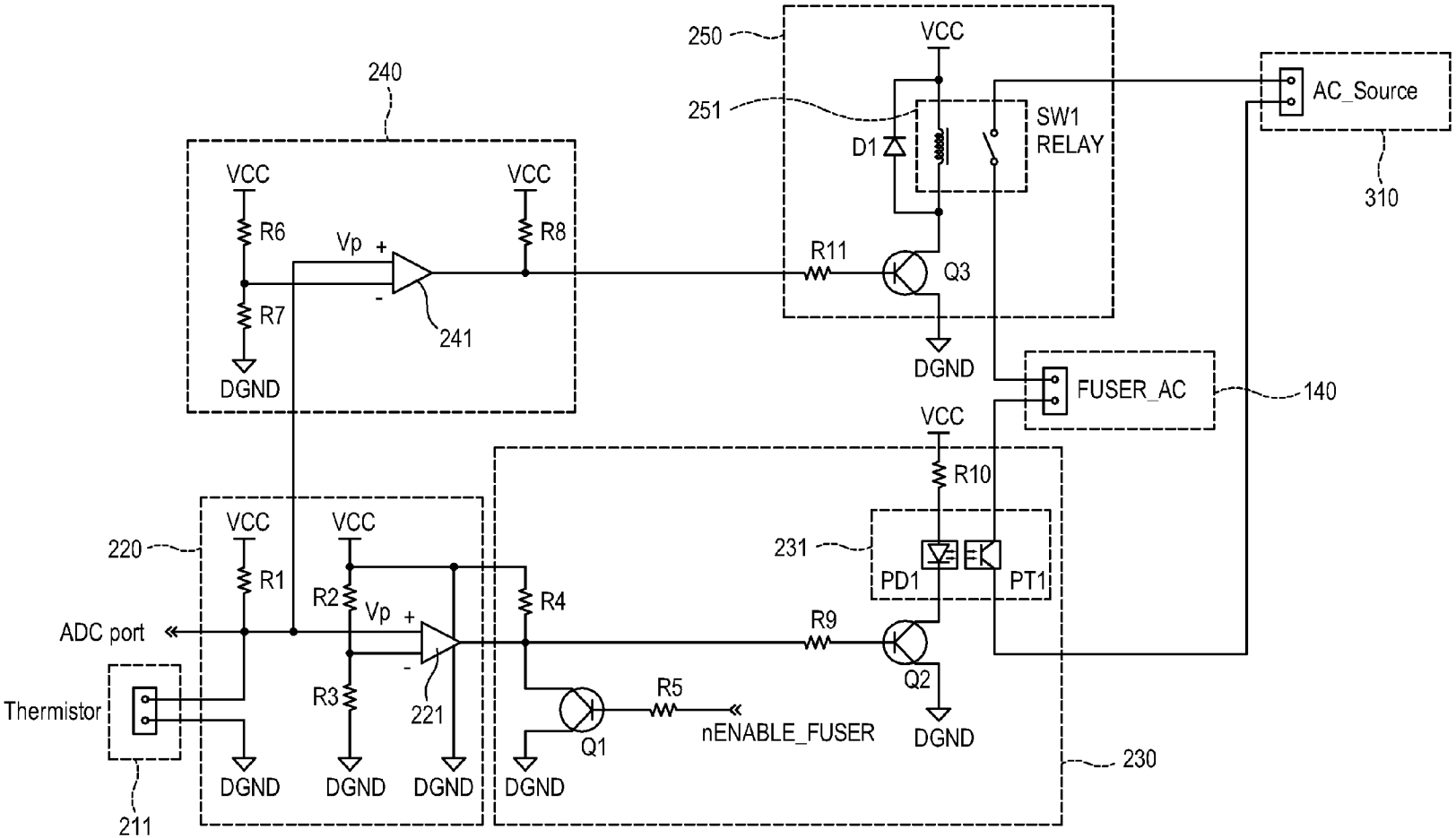
FIG. 3 is a circuit diagram of a fixing unit protection circuit of the image forming apparatus according to the first exemplary embodiment.

FIG. 2 is a block diagram showing a configuration of an image forming apparatus according to a first exemplary embodiment, and FIG. 3 is a circuit diagram of a fixing unit protection circuit of the image forming apparatus according to the first exemplary embodiment.

As shown in FIG. 2, the image forming apparatus according to the first exemplary embodiment further includes a temperature sensor 210, a first protection unit 220, a switching unit 230, a second protection unit 240, a relay unit 250, a power supply 310, and a controller 350 in addition to the configuration of FIG. 1.

Specifically, as shown in FIG. 3, the first protection unit 220 and the second protection unit 240 respectively include a first comparator 221 and a second comparator 241 to receive a voltage detected by the temperature sensor 210, i.e., a detected voltage Vp of the thermistor 211 and a reference voltage, and output comparison results between the received detected voltage Vp and the reference voltage.

If the detected voltage is lower than the reference voltage, the first comparator 221 and the second comparator 241 respectively output error signals (e.g., low signals) to turn off the switching unit 230 and the relay unit 250 and shut power off to the fixing unit 140. Here, the reference voltage may be set arbitrarily (e.g., 1.65V).

As shown in FIG. 3, the switching unit 230 includes a photo coupler 231, and the relay unit 250 includes a relay switch SW1 251. The photo coupler 231 includes a light emitting unit PD1 and a light receiving unit PT1 to receive an optical signal from the light emitting unit PD1. Here, the photo coupler 231 is a semiconductor device. However, the photo coupler 231 may be replaced by other semiconductor devices capable of turning on/off to pass through/cut off power supplied to the fixing unit 140. Additionally, the relay switch SW1 251 may be replaced by other switches capable of physically switching to turn on/off to pass through/cut off power supplied to the fixing unit 140.

Referring to FIG. 3, the first protection unit 220 may further include resistors R2 and R3, and the switching unit 230 may further include resistors R4, R5, R9 and R10 and transistors Q1 and Q2. Also, the second protection unit 240 may further include resistors R6 and R7, and the relay unit 250 may further include a resistor R11, a transistor Q3 and a diode D1.

The temperature sensor 210 uses the thermistor 211 as a thermal resistor contacting the fixing unit 140 to sense a temperature of the fixing unit 140, thereby outputting a voltage.

The temperature sensor 210 reads resistance of the thermistor 211 and senses the temperature of the fixing unit 140. That is, the temperature of the fixing unit 140 is converted into a voltage generated based on a ratio between the resistance of the thermistor 211 and the resistance of the resistor R1, and transmitted to the controller 350 through an analog/digital converter (ADC) port.

The controller 350 may be achieved by a central processing unit (CPU) for generally controlling operations of the image forming apparatus.

The controller 350 outputs a signal nENABLE_FUSER for controlling the fixing unit 140 in accordance with a target temperature on the basis of a fixing algorithm, and controls the fixing unit 140 to maintain proper temperature.

Specifically, the controller 350 receives a detected voltage Vp through the ADC port, and outputs an on/off signal to the switching unit 230 through a general purpose output (GPO) port, thereby controlling a power on/off so that the fixing unit 140 can maintain proper fixing temperature on the basis of the fixing algorithm.

For example, if power supplied to the fixing unit 140 is on, alternating current (AC) power is supplied to the fixing unit 140 and thus the temperature of the fixing unit 140 increases. If the controller 350 determines that the temperature excessively increases on the basis of the voltage detected by the temperature sensor 210, it outputs the control signal nENABLE_FUSER to the switching unit 230 to shut power off to the fixing unit 140.

That is, the transistors Q1 and Q3 are turned on or off on the basis of the control signal nENABLE_FUSER from the controller 350, so that the photo coupler 231 can be controlled to be turned on/off.

The power supply 310 supplies operating power to the elements of the image forming apparatus. In detail, the power supply 310 controls the power supplied to the fixing unit 130 under control of the controller 350.

The first protection unit 220 and the second protection unit 240 compare the voltage of the thermistor 211 with a predetermined reference voltage, and output one of high and low signals on the basis of the comparison results.

The first comparator 221 includes a (+) terminal to which the detected voltage Vp, i.e., the same level as an input level of the ADC port of the controller 350 is input, and a (−) terminal to which the reference voltage is input.

If the temperature of the fixing unit 140 increases and thus the detected voltage Vp is lower than the reference voltage, the output signal of the first comparator 221 operates the transistor Q2 and the photo coupler 231 is turned off. Thus, circuit control is possible to prevent the fixing unit 140 from having higher than a certain temperature.

Thus, the first protection unit 220 turns off the photo coupler 231 if the first comparator 221 outputs an error signal regardless of the fixing unit control of the controller 350, thereby shutting off the AC power supplied from the power supply (AC source) 310 to the fixing unit 140.

The second comparator 241 includes a (+) terminal to which the temperature of the fixing unit 140, i.e., the same level as an input level of the ADC port of the controller 350 is input, and a (−) terminal to which the reference voltage is input.

If the temperature of the fixing unit 140 increases and thus the detected voltage Vp is lower than the reference voltage, the output signal of the second comparator 241 operates the transistor Q3 and the diode D1 and the relay switch 251 is turned off. Thus, the fixing unit 140 is prevented from continuing in the on state and igniting.

Thus, the second protection unit 240 turns off the relay switch 251 if the second comparator 241 outputs an error signal regardless of the fixing unit control of the controller 350, thereby shutting off the AC power supplied from the power supply (AC source) 310 to the fixing unit 140.

As above, in the image forming apparatus according to the first exemplary embodiment, the power supplied to the fixing unit 140 is shut on/off by the switching unit 230 provided as a protection means for the fixing unit 140 even if there is an error by the controller 350 in controlling the power supplied to the fixing unit 140, the fixing unit 140 can be protected in light of a circuit.

Here, the photo coupler 231 of the switching unit 230 is a semiconductor device which may malfunction and be damaged by an external shock. If the photo coupler 230 is damaged, its instability may cause repetitive abnormal operations.

Accordingly, in the image forming apparatus according to the first exemplary embodiment, the relay unit 250 of the second protection unit 240 shuts off power supplied to the fixing unit 140 to thereby protect the fixing unit 140 even if the photo coupler 231 of the switching unit 230 provided as the protection means for the fixing unit 140 is damaged or abnormally operated, or even if there is an error in the fixing unit control of the controller 350.

Figure 4:
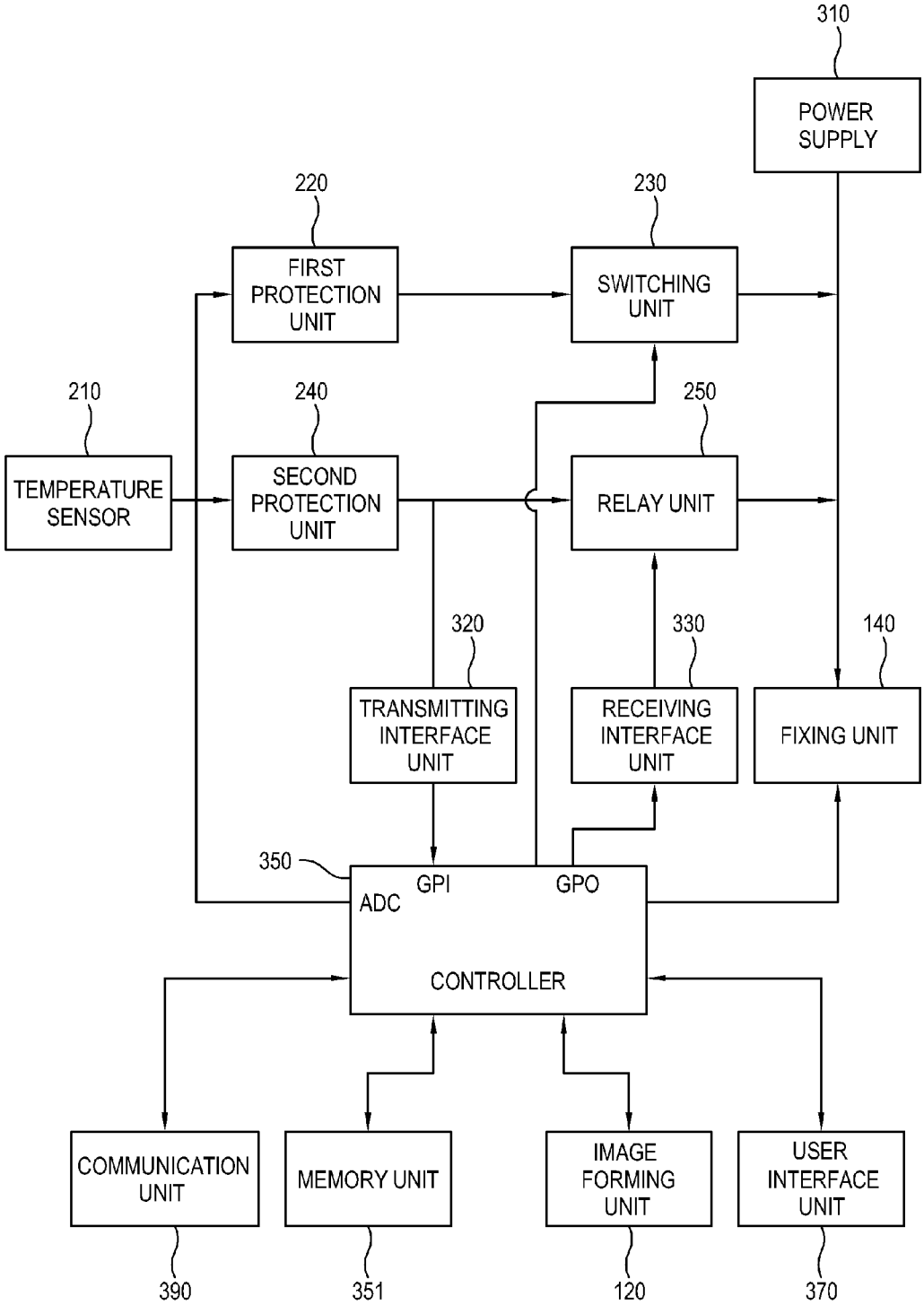
FIG. 4 is a block diagram showing a configuration of an image forming apparatus according to a second exemplary embodiment.
Figure 5:
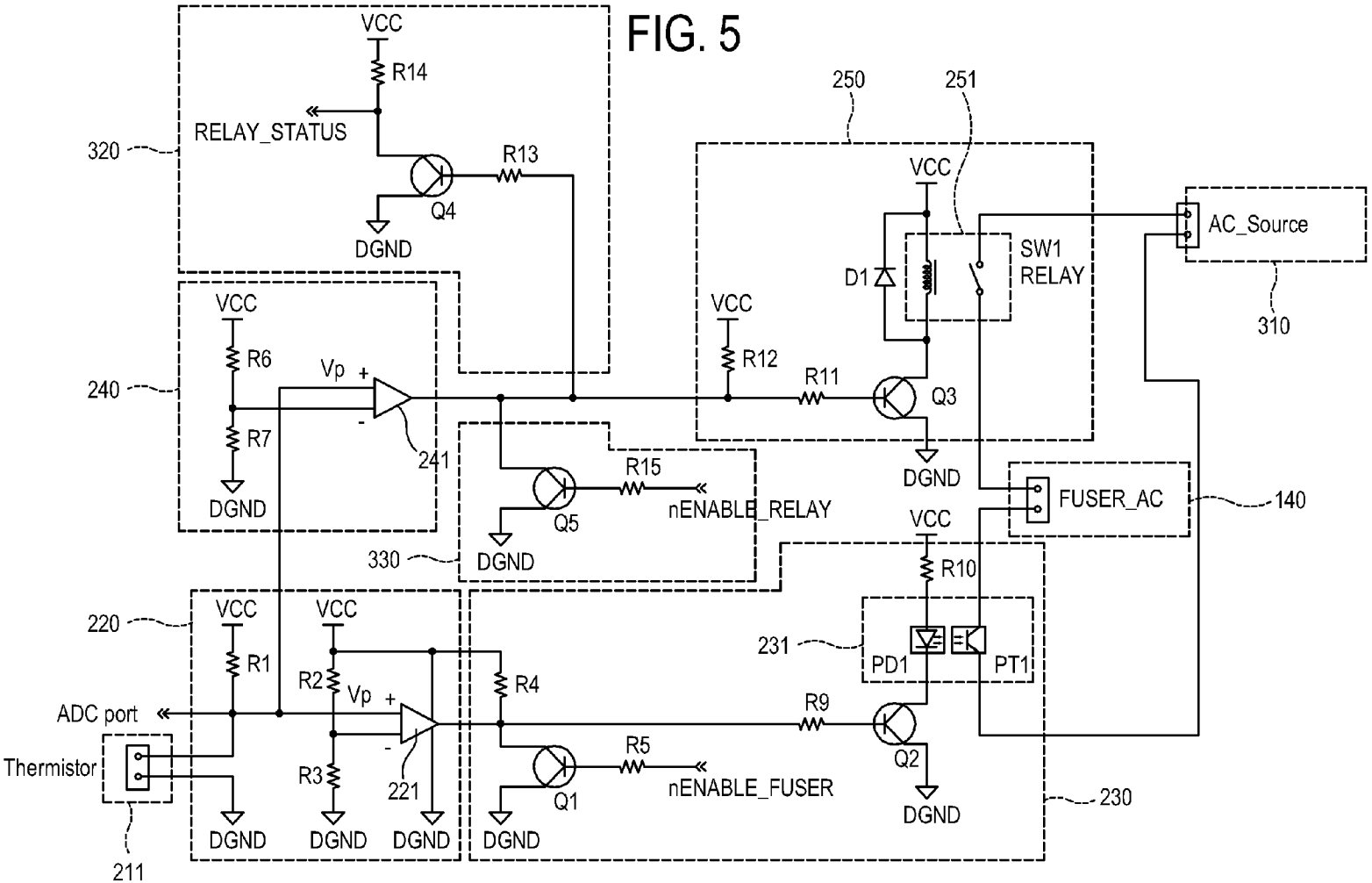
FIG. 5 is a circuit diagram of a fixing unit protection circuit of the image forming apparatus according to the second exemplary embodiment.

FIG. 4 is a block diagram showing a configuration of an image forming apparatus according to a second exemplary embodiment, and FIG. 5 is a circuit diagram of a fixing unit protection circuit of the image forming apparatus according to the second exemplary embodiment.

As shown in FIGS. 4 and 5, the image forming apparatus according to the second exemplary embodiment may further include a transmitting interface unit 320, a receiving interface unit 330, a memory unit 351, a user interface unit 370 and a communication unit 390 in addition to the image forming apparatus according to the first exemplary embodiment. Here, like numerals refer to like embodiments throughout, and repetitive descriptions will be avoided as necessary.

As shown in FIG. 5, the transmitting interface unit 320 includes resistors R13 and R14, and a transistor Q4. The receiving interface unit 320 includes a resistor 115 and a transistor Q5.

The transmitting interface unit 320 branches off the output signal of the second protection unit 240, and sends a level RELAY_STATUS of the control signal to turn on/off the relay unit 250 output from the second comparator 241 to a general purpose input (GPI) port of the controller 350.

That is, the transmitting interface unit 320 senses that a signal from the second protection unit 240 is changed from a level for turning on the relay unit 250 to a level for turning off the relay unit 250, and transmits it to the controller 350.

Then, the controller 350 receives it and determines that the operation is abnormal if the number of times the relay unit 250 is turned on/off due to change in a signal level is more than a reference number of times, thereby outputting a control signal for turning off the relay switch 251 through the GPO port.

In other words, the controller 350 receives a level RELAY_STATUS of the control signal output from the second protection unit 240 through the transmitting interface unit 320, and counts the number of times the relay switch 251 of the relay unit 250 is turned on/off. If the counted number is more than the reference number of times, the controller 350 outputs a control signal nENABLE_RELAY for turning off the relay unit 250. For example, the reference number of times may be set in the range of 3 to 5 times.

The receiving interface unit 330 receives the control signal nENABLE_RELAY from the controller 350, and transmits it to the relay unit 250.

On the basis of the control signal nENABLE_RELAY of the controller 350, the transistor Q3 and the diode D1 operate and the relay switch 251 is turned off, so that the fixing unit 140 can be repetitively turned on/off and thus prevented from being increased in temperature.

The memory unit 351 stores the number of repetitive on/off times of the relay unit 250 that are detected and transmitted through the transmitting interface unit 320.

The memory unit 351 includes a read only memory (ROM) and a random access memory (RAM) for operating the image forming apparatus, and may further include a separate non-volatile memory for storing the number of on/off times of the relay unit 250.

The controller 350 controls preset one of a volatile memory (i.e., RAM) and the non-volatile memory to store the number of repetitive on/off times of the relay unit 250 counted in accordance with the level change of the signal transmitted through the transmitting interface unit 320.

The controller 350 outputs the control signal nENABLE_RELAY for turning off the relay unit 250 if the number of repetitive on/off times of the relay unit 250 stored in the memory unit 351 is more than a predetermined reference number of times (e.g., 3 to 5 times). Thus, the relay unit 250 is turned off, and power supplied from the power supply 310 to the fixing unit 140 is shut off.

In the case where the memory unit 351 is a volatile memory, the number of repetitive on/off times of the relay unit 250 stored in the memory unit 351 is initialized whenever the image forming apparatus is powered on.

On the other hand, in the case where the memory unit 351 is a non-volatile memory, the number of repetitive on/off times of the relay unit 250 stored in the memory unit 351 is accumulatively stored irrespective of whether the image forming apparatus is powered on. In this case, the memory unit 351 may accumulate and store the number of on/off times of the relay unit 250 from the time of purchase or another set point in time.

When the image forming apparatus is powered on, the controller 350 determines whether the number of on/off times of the relay unit 250 accumulatively stored in the memory unit 351 is more than the reference number of times, and outputs the control signal nENABLE_RELAY to turn off the relay unit 250 if the number of on/off times of the relay unit 250 is more than the reference number of times.

Meanwhile, if the memory unit 351 is the non-volatile memory, the controller 350 may control the memory unit 351 to store the number of times of shutting power off to the fixing unit 140 in accordance with repetitive turning on/off of the relay unit 250.

Specifically, the controller 350 controls the memory unit 351 to store the number of times of shutting power off to the fixing unit 140 by the control signal to turn off the relay unit 250 and outputs the control signal for stopping the operation of the image forming apparatus if the number of times of shutting power off to the fixing unit 140 stored in the memory unit 351 is more than the reference number of times (e.g., three times) when the image forming apparatus is powered on. Thus, since it is determined as an abnormal operation that the relay unit 250 continuously turns on and off, the image forming apparatus is disabled so that check and repair can be induced.

Here, the number of times for shutting power off to the fixing unit 140 stored in the memory unit 351 may be accumulatively stored. That is, the memory unit 351 may accumulate and store the number of on/off times of the relay unit 250 from the time of purchase or another set point in time.

Accordingly, if an error in the operation of the fixing unit 140 is suspected on the basis of previous control records, the AC power input to the fixing unit 140 is physically shut off, thereby more effectively protecting the apparatus. That is, if abnormal operations occur many times, the image forming apparatus may have potential problems and needs to be repaired. Thus, the number of off times accumulated in the non-volatile memory is determined at a point of time when the image forming apparatus is powered on and initialized. If the number of off times is equal to or more than the reference number of times, the repair is induced by making the image forming apparatus disable, and potential PL accidents can be prevented in advance.

Meanwhile, the non-volatile memory can also be set up to initialize the previously stored number of on/off times of the relay unit 250 or power shut-off times of the fixing unit 140 whenever powered on or at a preset time (e.g., after a part is replaced, after after-sales service, etc.).

Further, the controller 350 may monitor the number of repetitive on/off times of the relay unit through the transmitting interface 320 and may output a control signal to turn off the relay unit 250 if the number of repetitive on/off times of the relay unit 250 is more than the reference number of times during a predetermined period of time (e.g., for one month).

In detail, if the number of repetitive on/off times of the relay unit 250, i.e., frequency of repeating on and off is less than the reference number of times, the controller 350 initializes the number of on/off times of the relay unit 250 stored in the memory unit 351 and accumulates the counts.

The controller 350 repeats such an operation for each predetermined period of time and detects an abnormal operation of the relay unit 250.

The relay switch 251 may be instantly turned on/off as temperature overshoots when the fixing unit 140 generates heat. Such a normal status can be distinguished from the abnormal status since the controller 350 initializes the number of on/off times accumulated for each predetermined period of time.

That is, the number of on/off times of the relay unit 250 due to overshooting instant fixing temperature that can occur as a normal operation are counted, and accumulated in the memory unit 251 for a long time, so that the image forming apparatus can be prevented from unnecessarily shutting power off to the fixing unit 140.

Also, the controller 350 may initialize the memory unit 351 in accordance with a preset cycle.

The user interface unit 370 informs a user that the relay unit 250 is turned off as a monitoring result through the transmitting interface unit 320. A user checks the instability of the apparatus through the user interface unit 370 and can identify when the apparatus needs to be repaired, thereby preventing the possibility of permanent failure.

The user interface unit 370 includes an input unit to receive a user's command, and a display unit to display an operating status of the image forming apparatus.

Also, the controller 350 may control the image forming unit 120 to print the off records, the number of accumulated off-times, etc. of the relay unit 250 stored in the memory unit 351 in accordance with a user's command.

Further, the controller 350 may transmit the off records of the relay unit 250 stored in the memory unit 351 to a management server through the communication unit 390 including a wired/wireless communication interface, so that a service engineer can recognize the abnormal operation of the image forming apparatus.

As above, in the image forming apparatus according to the second exemplary embodiment, the circuit of the fixing unit 140 can be protected by turning on and off power supplied to the fixing unit 140 through the switching unit 230 provided as a protection means for the fixing unit 140 even if there is an error in the fixing unit control of the controller 350.

In addition, even if the photo coupler 231 of the switching unit 230 is damaged or malfunctions, or if there is error in the fixing unit control of the controller 350, the relay unit 250 of the second protection unit 240 shuts power off to the fixing unit 140, thereby protecting the fixing unit 140.

Here, if the photo coupler 231 malfunctions or is damaged, the protection can be carried out by the relay switch 251. However, if the relay switch 251 is repetitively turned on and off, a high temperature may be continuously maintained inside the image forming apparatus. That is, it is possible to prevent the temperature of the fixing unit 140 from increasing to a certain temperature or higher. However, if the high temperature is continuously maintained without completely shutting off power to the fixing unit 140, errors may occur.

For instance, if the relay switch 251 is repetitively turned on and off while AC power is supplied, devices around the fixing unit 140 may be deformed or generate a spark, so that the performance of the relay switch 251 can be deteriorated or a fire can break out by the spark due to increased contact resistance.

Accordingly, the image forming apparatus according to the second exemplary embodiment detects a level of a signal to turn on/off the relay unit 250 and completely shuts off the relay unit 250 if the turning on/off is repeated more than the reference number of times. Thus, it is possible to prevent damage of the fixing unit 140 due to a continuously-maintained high temperature status, a fire hazard due to the spark, etc.

Also, the image forming apparatus according to the second exemplary embodiment determines previous control records accumulated in the non-volatile memory, i.e., the number of off times, when powered on and initialized, so that the repair is induced by disabling the image forming apparatus, and potential PL accidents can be prevented in advance if the number of off times is equal to or more than the reference number of times.

Further, the image forming apparatus according to the second exemplary embodiment initializes the number of on/off times accumulated for each predetermined period of time, and distinguishes between the off status of the relay unit 250 due to the overshooting instant fixing temperature that can occur in the normal status from the abnormal status, thereby preventing the image forming apparatus from unnecessarily shutting power off to the fixing unit 140.

Furthermore, the image forming apparatus according to the second exemplary embodiment notifies a user of the off status of the relay unit 250 through the user interface unit 370, the communication unit 390, printing, etc., thereby inducing a user to repair and preventing potential permanent failure.

Hereinafter, a fixing unit control method of an image forming apparatus with the foregoing configuration will be described with reference to FIGS. 6, 7 and 8.

Figure 6:
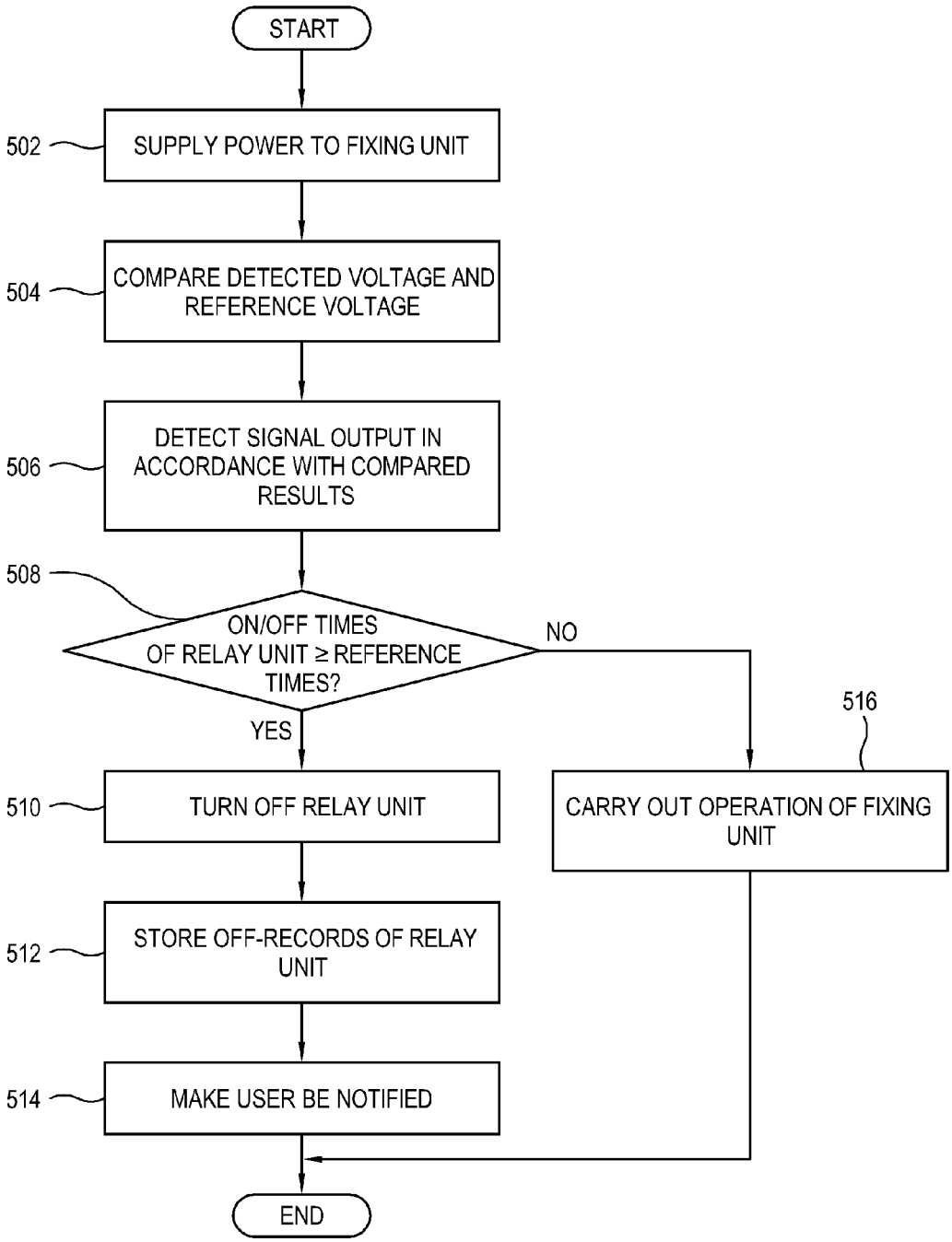
FIGS. 6 to 8 are flowcharts showing a fixing unit control method of the image forming apparatus according to the second exemplary embodiment.

FIG. 6 is a flowchart showing a fixing unit control method of the image forming apparatus according to the second exemplary embodiment.

As shown in FIG. 6, if the image forming apparatus receives a printing command and carries out the printing, AC power is supplied to the fixing unit 140 for fixing an image at operation 502.

If the fixing unit 140 receives the power, its temperature increases. The second comparator 240 compares the detected voltage output from the temperature sensor 210 with the reference voltage, and outputs a signal having a predetermined level for controlling the relay unit 250 to be turned on/off on the basis of a comparison result at operation 504.

The transmitting interface unit 320 detects a signal output in accordance with the comparison result in the operation 504, and transmits it to the controller 350 at operation 506.

The controller 350 counts the number of times the relay unit 250 is turned on/off on the basis of the level of the signal transmitted in the operation 506, and determines whether the number of on/off times of the relay unit 250 is equal to or more than the reference number of times at operation 508.

As a determination result in the operation 508, if the number of on/off times of the relay unit 250 is equal to or more than the reference number of times, the controller 350 outputs a control signal for turning off the relay unit 250 to the relay unit 250 through the receiving interface unit 330 at operation 510. Here, the controller 350 may output the control signal for turning off the relay unit 250 if the number of on/off times of the relay unit 250 is equal to or more than the reference number of times for a preset period of time.

At operation 512, the controller 350 controls the memory unit 351 to store the records of times the relay unit 250 is turned off by the controller 350 in the operation 510. Here, the records of times the relay unit 250 is turned off by the controller 350 stored in the memory unit 351 may be initialized, i.e., deleted, when the image forming apparatus is powered on or at each preset period of time. Also, as necessary, the memory unit 351 may accumulatively store the records of times the relay unit 250 is turned of by controller 350 from the time of purchase or another set point in time.

Further, the controller 350 may control at least one of the user interface unit 370, the communication unit 390 and the image forming unit 120 to inform a user of the records of times the relay unit 250 is turned off by controller 350 at operation 514.

In the operation 508, if the number of on/off times of the relay unit 250 is less than the reference number of times, the image forming apparatus may normally carry out the fixing operation of the fixing unit 140 at operation 516.

Figure 7:
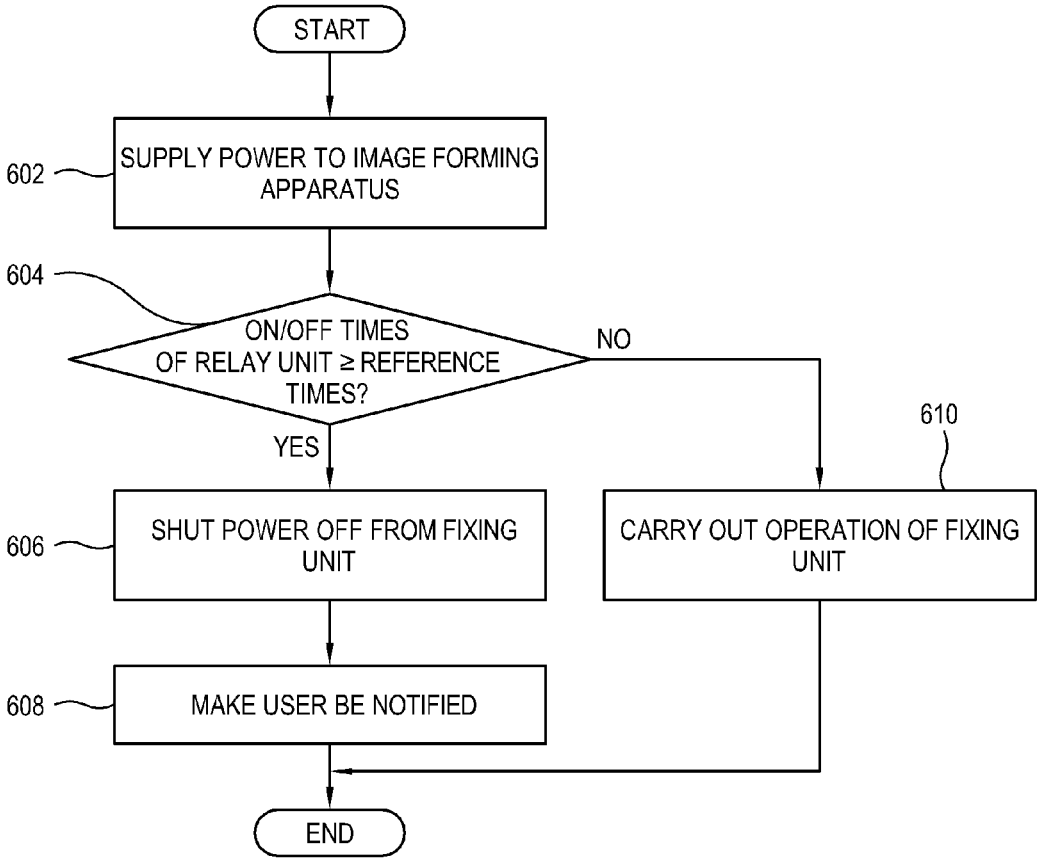

FIG. 7 is a flowchart showing another fixing unit control method of the image forming apparatus according to the second exemplary embodiment.

In the exemplary embodiment of FIG. 7, the memory unit 351 is achieved by the non-volatile memory, which corresponds to a case where the image forming apparatus is powered on in the state that the repetitive on/oft records of the relay unit are accumulatively stored in the memory unit 351 by the exemplary embodiment of FIG. 6.

As shown in FIG. 7, power is supplied to the image forming apparatus in response to a power supply command at operation 602. Here, the power supply command includes not only a user's power button control for supplying power, but also a wake-up command for the image forming apparatus by a printing command received in a standby status.

The controller 350 determines whether the number of on/off times of the relay unit 250 accumulatively stored in the memory unit 351 is equal to or more than the reference number of times at operation 604.

If the number of on/off times of the relay unit 250 is equal to or more than the reference number of times in the operation 604, the controller 350 outputs a control signal for turning off the relay unit 250 through the receiving interface unit 330, and shuts off AC power to the fixing unit 140 at operation 606.

Further, the controller 350 controls one of the user interface unit 370, the communication unit 390 and the image forming unit 120 to inform a user that the power supplied to the fixing unit 140 is shut off at operation 608.

In the operation 604, if the number of on/off times of the relay unit 250 is less than the reference number of times, the image forming apparatus normally carries out the fixing operation of the fixing unit 140 at operation 610.

Figure 8:
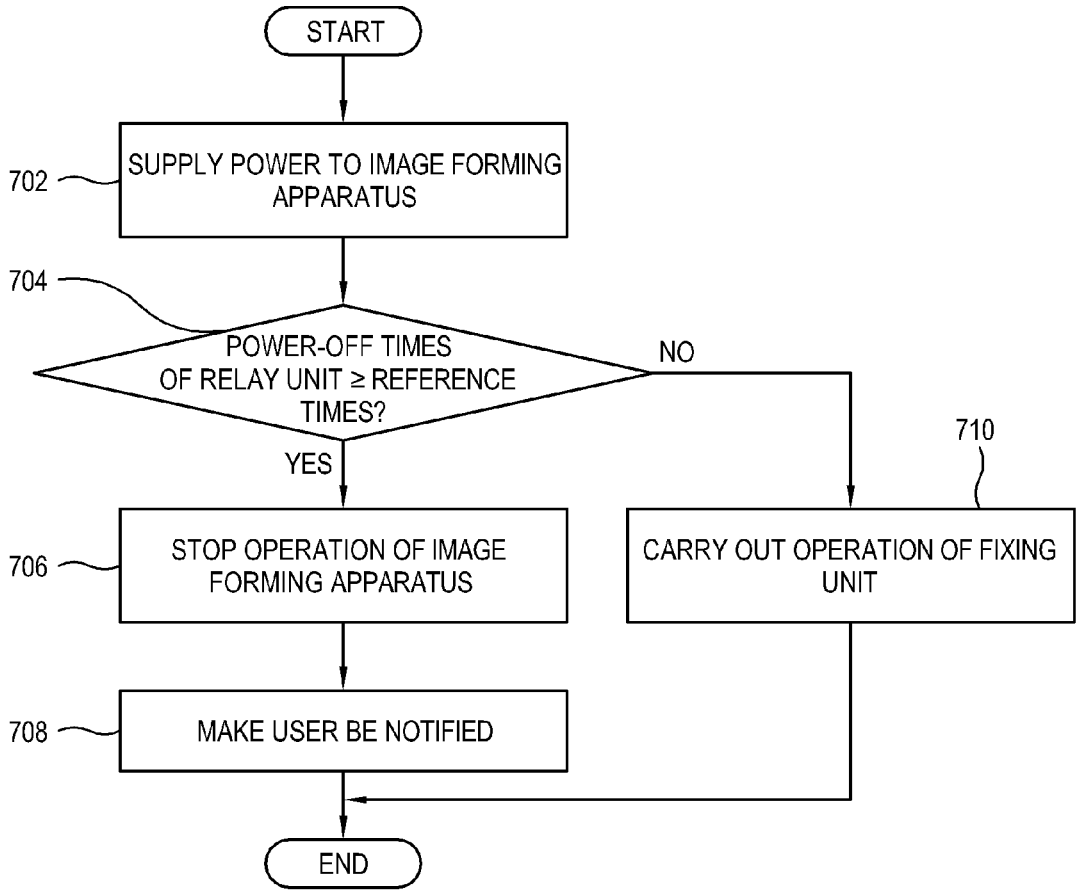

FIG. 8 is a flowchart showing still another fixing unit control method of the image forming apparatus according to the second exemplary embodiment.

In the exemplary embodiment of FIG. 8, the memory unit 351 is achieved by the non-volatile memory, which corresponds to a case where the image forming apparatus is powered on in the state that the power-off records of the fixing unit 140 due to the off status of the relay unit are stored in the memory unit 351 by the exemplary embodiment of FIG. 6.

As shown in FIG. 8, power is supplied to the image forming apparatus in response to a power supply command at operation 702. Here, the power supply command includes not only a user's power button control for supplying power, but also a wake-up command for the image forming apparatus by a printing command received in a standby status.

The controller 350 determines whether the number of power-off times of the fixing unit 140 stored in the memory unit 351 is equal to or more than the reference number of times at operation 704.

If the number of power-off times of the fixing unit 140 are equal to or more than the reference number of times in the operation 704, the controller 350 stops operation of the image forming apparatus at operation 706. Here, the stopped operation may include the operation of the image forming unit 120 including the fixing operation.

Further, the controller 350 controls one of the user interface unit 370, the communication unit 390 and the image forming unit 120 to inform a user that the image forming apparatus stops operating at operation 708.

In the operation 704, if the number of power-off times of the fixing unit 140 is less than the reference number of times, the image forming apparatus normally carries out the fixing operation of the fixing unit 140 and other operations at operation 710.

As described above, there are provided an image forming apparatus and a fixing unit control method thereof, in which a protection unit provides hardware control of a fixing unit when the fixing unit is abnormally overheated, so that a product liability (PL) accident due to error in temperature control for the fixing unit can be prevented and the fixing unit can be protected.

Also, a relay switch is forcibly turned off to shut power off to the fixing unit if the relay switch is repetitively turned on/off, so that the image forming apparatus can be prevented from permanent failure.

Further, it is recorded whether a relay switch is repetitively turned on/off, and the power to the fixing unit is shut off, etc. while informing a user of the shutting off of power, so that after-sales service can be smoothly provided as necessary.

Furthermore, the number of repetitive on/off times of the relay switch is counted for each predetermined period of time, and on/off due to temporary overshooting and on/off due to operation error are distinguished, so that parts can be prevented from being replaced recklessly.

Further, an abnormal operation record of the fixing unit is stored in a non-volatile memory and grasped by a management server, so that a manufacturer can understand problems with power control of the fixing unit and gradually improve them.

Although a few exemplary embodiments have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus comprising:

an image forming unit to form an image and to transfer the image onto a printing medium;

a fixing unit to fix the image transferred onto the printing medium;

a power supply to supply operating power to the fixing unit;

a temperature sensor to sense a temperature of the fixing unit;

a first protection unit to compare the sensed result of the temperature sensor with a first predetermined reference value and to output a signal according to a comparison result between the sensed result of the temperature sensor and the first predetermined reference value, the first protection unit comprising a first comparator to receive a voltage from the temperature sensor and a first predetermined reference voltage and to output a signal according to a comparison result between the received voltage and the first predetermined reference voltage;

a switching unit to turn on or off in order to respectively pass through or cut off the operating power supplied to the fixing unit in accordance with a level of the signal output from the first protection unit;

a second protection unit to compare the sensed result of the temperature sensor with a second predetermined reference value and to output a signal according to a comparison result between the sensed result of the temperature sensor and the second predetermined reference value, the second protection unit comprising a second comparator to receive a voltage of the temperature sensor and a second predetermined reference voltage and to output a signal according to a comparison result between the received voltage and the second predetermined reference voltage;

a relay unit to turn on or off in order to respectively pass through or cut off the operating power supplied to the fixing unit in accordance with a level of the signal output from the second protection unit; and a controller to receive the sensed result of the temperature sensor through an analog digital converter (ADC) port and to control a switching operation of the switching unit in accordance with the received sensed result.

2. The image forming apparatus according to claim 1, wherein the switching unit comprises a photo coupler to turn on or off in accordance with the signal output from the first comparator.

3. The image forming apparatus according to claim 1, wherein the relay unit comprises a relay switch to turn on or off in accordance with the signal output from the second comparator.

4. The image forming apparatus according to claim 1, further comprising a transmitting interface unit to transmit the level of the signal output from the second protection unit to the controller; and a receiving interface unit to receive the control signal from the controller to turn off the relay unit and to output the control signal to the relay unit, and the controller counts a number of times that the relay unit is turned on or off in accordance with the level of the signal received from the transmitting interface unit, and outputs the control signal to turn off the relay unit to the receiving interface unit if the counted number of times that the relay unit is turned on or off is equal to or more than the first reference number of times.

5. The image forming apparatus according to claim 4, further comprising:

a memory unit to store the number of times that the relay unit is turned on or off, and the controller outputs the control signal to turn off the relay unit if the number of times that the relay unit is turned on or off stored in the memory unit is equal to or more than the first reference number of times.

6. The image forming apparatus according to claim 5, wherein the number of times that the relay unit is turned on or off stored in the memory unit is initialized when the image forming apparatus is powered on.

7. The image forming apparatus according to claim 5, wherein the memory unit comprises a non-volatile memory.

8. The image forming apparatus according to claim 5, wherein the memory unit stores the number of times that the control signal to turn off the relay unit is output, and the controller checks, when the image forming apparatus is powered on, the number of times that the control signal to turn off the relay unit is output which is stored in the memory unit, and stops operating the image forming apparatus if the checked number of off-times is equal to or more than a second reference number of times.

9. The image forming apparatus according to claim 8, wherein the controller checks the number of times that the relay unit is turned on or off accumulated in the memory unit when the image forming apparatus is powered on, and outputs the control signal to turn off the relay unit if the checked number of accumulated off-times is equal to or more than the first reference number of times.

10. The image forming apparatus according to claim 4, wherein the controller outputs a control signal to turn off the relay unit if the number of times that the relay unit is turned on or off is equal to or more than the first reference number of times during a predetermined period of time.

11. The image forming apparatus according to claim 4, further comprising a user interface unit to inform a user of an off-status of the relay unit.

12. A fixing unit control method of an image forming apparatus comprising an image forming unit to form an image and to transfer the image onto a printing medium, a fixing unit to fix the image transferred onto the printing medium, and a power supply to supply operating power to the fixing unit, the method comprising:

sensing a temperature of the fixing unit;

comparing a sensed result of the temperature sensing with a predetermined reference value and outputting a comparison result; and turning on or off the operating power supplied to the fixing unit in accordance with the comparison result, wherein the image forming apparatus further comprises a first protection unit to compare the sensed result with a first predetermined reference value and to output a signal according to a comparison result between the sensed result and the first predetermined reference value, and a second protection unit to compare the sensed result with a second predetermined reference value and to output a signal according to a comparison result between the sensed result and the second predetermined reference value, the first protection unit comprising a first comparator to receive a voltage from a temperature sensor and the first predetermined reference voltage and the second protection unit comprising a second comparator to receive a voltage of the temperature sensor and the second predetermined reference voltage, and the turning on or off of the operating power comprises turning off the operating power supplied to the fixing unit according to the signal output from at least one of the first protection unit and the second protection unit.

13. The method according to claim 12, wherein the image forming apparatus comprises a switching unit to turn on or off in order to respectively pass through or cut off the operating power supplied to the fixing unit in accordance with a level of the signal output from the first protection unit, and a relay unit to turn on or off in order to respectively pass through or cut off the operating power supplied to the fixing unit in accordance with a level of the signal output from the second protection unit, and the method further comprises:

receiving the level of the signal output from the second protection unit to turn on or off the relay unit;

counting a number of times that the relay unit is turned on or off in accordance with the received level of the signal output from the second protection unit; and outputting a control signal to turn off the relay unit if the counted number of times is equal to or more than the reference number of times.

14. The method according to claim 13, further comprising:

storing the number of times that the relay unit is turned on or off in a memory unit, and wherein the outputting the control signal comprises outputting a control signal to turn off the relay unit if the number of times that the relay unit is turned on or off stored in the memory unit is equal to or more than the reference number of times.

15. The method according to claim 14, wherein the number of times that the relay unit is turned on or off stored in the memory unit is initialized when the image forming apparatus is powered on.

16. The method according to claim 14, wherein the memory unit comprises a non-volatile memory.

17. The method according to claim 14, further comprising printing information about the number of times that the relay unit is turned on or off stored in the memory unit.

18. The method according to claim 14, further comprising:

checking the number of times that the relay unit is turned on or off accumulated in the memory unit when the image forming apparatus is powered on; and outputting the control signal to turn off the relay unit to shut power off to the fixing unit if the checked number of accumulated off times is equal to or more than the reference number of times.

19. The method according to claim 13, wherein the counting comprises counting the number of times that the relay unit is turned on or off during a preset period of time, and the outputting the control signal comprises outputting the control signal to turn off the relay unit if the counted number of times that the relay unit is turned on or off is equal to or more than the reference number of times during the preset period of time.

20. The method according to claim 19, further comprising:

informing a user of an off-status of the relay unit.

21. An image forming apparatus comprising:

a fixing unit to fix an image onto a printing medium;

a power supply to supply operating power to the fixing unit;

a temperature sensor to sense a temperature of the fixing unit;

a protection unit to compare the sensed temperature with a predetermined reference value and to output a signal in accordance with a comparison result between the sensed temperature and the predetermined reference value, the protection unit comprising a first comparator to receive a voltage from the temperature sensor and a first predetermined reference voltage and to output a signal according to a comparison result between the received voltage and the first predetermined reference voltage and a second comparator to receive a voltage of the temperature sensor and a second predetermined reference voltage and to output a signal according to a comparison result between the received voltage and the second predetermined reference voltage;

a switching unit disposed between the power supply and the fixing unit and including a semiconductor switch to turn on or off in order to respectively pass through or cut off the operating power supplied to the fixing unit in accordance with a level of the signal output from the first comparator;

a relay unit disposed between the power supply and the fixing unit and including a physical switch to turn on or off in order to respectively pass through or cut off the operating power supplied to the fixing unit in accordance with the level of the signal output from the second comparator; and a controller to receive the sensed result of the temperature sensor through an analog digital converter (ADC) port and to control a switching operation of the switching unit in accordance with the received sensed result.

22. The image forming apparatus according to claim 21, wherein the controller is further configured to output a control signal to turn on or off the semiconductor switch in accordance with the sensed temperature and a target temperature.

23. The image forming apparatus according to claim 22, wherein the controller counts a number of times the physical switch is turned on or off and outputs a control signal to turn off the physical switch when the counted number of times that the physical switch is turned on or off is equal to or greater than a first predetermined reference number of times.

24. The image forming apparatus according to claim 23, wherein the controller counts the number times that the physical switch is turned on or off from a time when the image forming apparatus is turned on.

25. The image forming apparatus according to claim 23, wherein the controller counts the number of times that the physical switch is turned on or off during a predetermined period of time.

26. The image forming apparatus according to claim 23, wherein the controller counts the number of times that the controller outputs the control signal to turn off the physical switch, and when the image forming apparatus is powered on, the controller disables the image forming apparatus if the counted number of times that the controller outputs the control signal to turn off the relay unit is equal to or greater than a second predetermined reference number.

27. The image forming apparatus according to claim 26, further comprising:

a memory unit to store the counted number of times that the physical switch is turned on or off and to store the counted number of times that the controller outputs the control signal to turn off the relay unit.

28. The image forming apparatus according to claim 23, further comprising:

a user interface unit to inform a user when the physical switch is turned off.

* * * * *